US007341436B2

(12) United States Patent
Andrews

(10) Patent No.: US 7,341,436 B2
(45) Date of Patent: Mar. 11, 2008

(54) OPEN FACE COOLING SYSTEM FOR SUBMERSIBLE MOTOR

(75) Inventor: Dale B Andrews, Derry, NH (US)

(73) Assignee: Lawrence Pumps, Inc., Lawrence, MN (US)

( * ) Notice: Subject to any disclaimer, the term of this patent is extended or adjusted under 35 U.S.C. 154(b) by 694 days.

(21) Appl. No.: 10/911,194

(22) Filed: Aug. 4, 2004

(65) Prior Publication Data

US 2005/0053494 A1 Mar. 10, 2005

Related U.S. Application Data

(60) Provisional application No. 60/500,166, filed on Sep. 4, 2003.

(51) Int. Cl.
*F04B 17/03* (2006.01)

(52) U.S. Cl. ..... 417/369

(58) Field of Classification Search ..... 417/369, 417/370

See application file for complete search history.

(56) References Cited

U.S. PATENT DOCUMENTS 2,925,041 A * 2/1960 Miroslav ..... 417/370
3,572,976 A * 3/1971 Sato ..... 417/369
4,134,711 A 1/1979 Ivins et al.
4,349,322 A 9/1982 Stahle
4,488,852 A 12/1984 Ivins et al.
4,808,087 A * 2/1989 Tsutsui et al. ..... 417/369
5,324,179 A * 6/1994 Nakagawa ..... 417/369
5,397,220 A * 3/1995 Akihisa et al. ..... 417/369
6,379,127 B1 4/2002 Andrews et al.

* cited by examiner

*Primary Examiner*—Michael Koczo, Jr.
(74) *Attorney, Agent, or Firm*—Vern Maine & Associates

(57) ABSTRACT

An open face cooling system for a motorized, impeller-type, submersible pump operated in a host fluid ladened with solids, comprising an inlet in the pump housing close to the impeller and away from the axis of the pump into which fluid is forced by pump pressure, the inlet arranged so the impeller vanes sweep its face with a shearing motion that reduces the size of any solids present there until they are small enough to enter the inlet with the fluid flow, the materials ladened fluid flowing hence through a coolant conduit, out of a tangentially configured nozzle into a rotational flow around the inside of an open face toroidal section, and hence inward through an adjoined, inward extending distribution section configured co-axially around and above the motor, to be discharged upon the motor.

19 Claims, 5 Drawing Sheets

OPEN FACE COOLING SYSTEM FOR SUBMERSIBLE MOTOR

This application relates and claims priority to application U.S. No. 60/500,166 filed Sep. 4, 2003, now abandoned.

FIELD OF THE INVENTION

This invention relates to the cooling of submersible motors. In particular it relates to the cooling of motors submerged in solids ladened liquid where the liquid is used for motor cooling; and more particularly, it related to submersible motorized pumps used in a solids ladened liquid where pump pressure is used to dispose a flow of the liquid on the motor for cooling.

BACKGROUND OF THE INVENTION

Submersible pumps are designed to remove liquids from tanks and sumps and to operate in a submerged condition. Submersible pumps typically rely on submergence for cooling of the motor. Running the motor exposed to air would result in overheating of the motor and its premature failure resulting in costly repairs and possibly flooding or lost production. Controls, which add expense and complexity to the installation, are often employed to assure that the liquid levels are not drawn down below motor height. However, in most cases it is desirous to the operators of these pumps to empty the contents of the tank or sump to the greatest extent possible. The added liquid inventory necessary to keep the motor submerged often represents cost due to unusable production, or in the case of chemical plants, hazardous materials that pose environmental risk.

Manufacturers have used a number of methods to allow submersible motors to operate unsubmerged without overheating of the motor. All of these methods either add unnecessary cost or are ineffective when handling liquids containing solids. Some manufacturers install submersible motors rated for a much higher horsepower than the application will require. This allows the motor to operate at a fraction of its load carrying capability and at a fraction of its full load temperature. If large enough, an oversized motor can run unsubmerged without overheating. Although effective, it is a costly solution both from the standpoint of the initial motor cost and from the fact that the motor, operating at a fraction of its full load power, is also operating at less than optimum efficiency.

Still other manufacturers have installed a cooling jacket onto the motor frame, through which a clean cooling media is circulated from an external source. This method has the advantages of allowing the motor to be sized for its rated load, and also allows the pump to operate in a solids ladened environment, but it has the inherent disadvantage of additional costs related to the jacketing and the circulation system for the cooling media. Other methods take a slip stream from the pumpage and use the pressure developed by the pump impeller to cool the motor. Methods that have used a slip stream from the pumpage have proven to be unsuitable for applications where solids and slurries are present because the jackets are susceptible to plugging from deposited solids.

Stahle U.S. Pat. No. 4,349,322 teaches a spiral groove in the sealing cover located in close proximity to the impeller to create a shearing action to reduce the size of solids within a solids bearing fluid stream passing between the impeller and the sealing cover. The inner radius of the solids reduction device delivers a reduced solids flow stream into a seepage collection channel that in turn is tangentially fed to a cooling jacket around the motor. It is a well known fact to those familiar with the art that the available pressure from a pump is reduced as a function of the diameter change from the outside diameter of the impeller to its axis. In relying on flow traveling from the impeller outside diameter to the area in the vicinity of the impeller hub, Stahle reduces the pressure available to supply the motor cooling jacket.

Submersible motor jackets have a relatively high volume compared to the annulus around the impeller hub. Entering the expanded area of the jacket causes the fluid velocity to be further reduced. This can cause heavier solids to precipitate out of solution and remain in the jacket. Over time the solids will accumulate in the jacket resulting in reduced cooling capacity and premature motor failure. Further disadvantages are that both the circumferential grooving used by Stahle for size reduction and the motor jacket are expensive to manufacture.

Ivans U.S. Pat. No. 4,134,711 teaches the use of a sparge ring around the motor to spray pumped media upon the motor to cool it. Ivans teaches an alternative to this in U.S. Pat. No. 4,488,852 where he describes nozzles arrayed around the motor to spray pumped media onto the motor to cool it. Both of these methods are ineffective when handling solids ladened liquids. Solids large enough to pass through the pump are large enough, in most cases, to plug the comparatively small openings of the nozzles or sparge ring. The nozzle system also has the additional disadvantage of being ineffective when the motor is only partially submerged such that the nozzles are still covered in liquid and most of the motor is exposed. Under this partially submerged condition the nozzle discharge becomes diffused by the surrounding liquid, does not effectively cool the exposed motor shell and results in overheating and subsequent failure of the motor.

SUMMARY OF THE INVENTION

According to the present invention, one objective is to provide a simple, relatively low cost, open loop cooling system for an electric motor powered submersible centrifugal pump to insure fluid cooling is delivered to the pump motor when the level of fluid in the fluid reservoir falls lower than the pump motor such that the motor would otherwise be running in air.

A further objective of the invention is to provide for a submersible motor a cooling system consisting of a solids tolerant coolant distributor coupled to a pressurized portion of a pump housing equipped with at least one continuously swept cooling system inlet and solids size reduction mechanism. The cooling system is operative by fluid pressure in the pump housing to evenly distribute solids ladened fluid over the motor, the solids ladened fluid being routed through an interconnecting conduit from the cooling system inlet. Solids of not more than a pre-determined maximum allowable size are admitted into the cooling system inlet so that they will not plug or otherwise foul the interconnecting conduit. The cooling fluid is conveyed in a directed manner onto the external surfaces of the motor.

The submersible motor may be a motorized submersible pump of the type adapted for disposition in a sump or tank for pumping fluid and solids solutions out of a sump or tank. The pump includes the submersible motor, a shaft seal, a drive shaft extending downward from the submersible motor, through the shaft seal, and an impeller coupled to the drive shaft for rotation of the impeller within a pump housing constructed of a casing with a fluid inlet and a seal chamber attached to the submersible motor. Submersible pump housings can be manufactured in many configurations both with and without seal chambers. The use of a seal chamber herein is by way of example and the innovative nature of this invention is not dependant on it.

In a typical configuration the coolant distributor is located on the upper portion of the submersible motor. It consists of a horizontally arranged toroidal section with the inside face being open somewhat like a tire, and a lower distribution section extending inward from the toroidal section and terminating adjacent to the upper part of the motor housing. The lower distribution section encircles the motor housing and is the discharge end of the cooling system. There may be a plurality of evenly spaced, radially inwardly oriented, straight or curved guide vanes or ribs on the inner surface of the lower distribution section.

Solids ladened fluid that enters the pump acquires pressure through the centrifugal action of the impeller. It is a fact known to those familiar with the art that the amount of pressure developed by a centrifugal impeller operating at constant rotational speed increases with the diameter of the impeller. A cooling system inlet is located in the pump housing, in close proximity to the rotating impeller, such that the vanes of the rotating impeller sweep across the face of the cooling system inlet, dislodging and reducing the particle size of any solids momentarily at the edge of the inlet and forcing fluid ladened with solids of not larger than suitable size into the inlet.

The cooling system inlet is preferably oriented normal to the plane of the impeller and at a distance from the axis or shaft smaller than the outside radius of the impeller. In all cases the cooling system inlet is at a sufficiently large distance from the axis or shaft that the pressure generated by the impeller is sufficient to impart a velocity to the solids ladened fluid that insures the solids will remain in suspension while the fluid is in the cooling system conduit.

Solids ladened fluid under pressure developed by the centrifugal action of the impeller enters the cooling system inlet, while the shearing action caused by the impeller vanes rotating in close proximity to the cooling system inlet opening reduces any solids in the fluid to a size that can pass through the inlet without blockage occurring. The discharge end of the cooling system is unrestricted in any way, so that back pressure at the cooling inlet is minimized and maximum velocity of fluid through the cooling system is sustained.

The cooling conduit is connected tangentially to the toroidal section of the coolant distributor. The fluid ladened with reduced sized solids traverses the cooling conduit and exits from the cooling conduit tangentially into the toroidal section of the coolant distributor at sufficient velocity to prevent the settling of solids and to carry the fluid and reduced sized solids through as much as 360 degrees or more of travel along the toroidal surface before falling into lower distribution section and encountering the guide-vanes that evenly distribute the fluid ladened with the reduced sized solids out the discharge end of the distributor and onto the external surfaces of the submersible motor. The annulus between the discharge end and the motor housing is of greater width than the maximum particle size of solids admitted into the cooling system, so that solids are discharged as readily from the system as fluids. Coolant distribution occurs in this manner even when the submersible pump is mounted somewhat out of plumb or level orientation, thus providing sufficient cooling capacity to the motor so as to allow the motor to be deployed without a precise leveling effort and operated unsubmerged in a loaded condition without overheating.

This innovative open cooling system is less expensive to manufacture than cooling jackets, provides no zones of low velocity fluid flow where solids might settle out, and lends itself to ease of access for maintenance. Another advantageous aspect of this embodiment is the use of a simple conduit arrangement that takes advantage of the inherent pressure generating and vane passing features of a centrifugal impeller to simultaneously provide both adequate size reduction and high fluid velocity such that plugging or settling out of solids does not occur, ensuring a continuous flow of cooling fluid to the motor, even when large solids are present in the submerging fluid. This is accomplished in a manner that is less costly to manufacture than other size reduction means and in a manner that provides high fluid pressures and velocities.

In another embodiment of the invention, the coolant system inlet in the pump housing is tapered axially such that the face or opening proximate the impeller is a smaller diameter than anywhere else in the coolant conduit, ensuring that any solids capable of entering the inlet are capable of passing through the entire length of the conduit.

In still another embodiment of the invention a vaneless coolant distributor is used in concert with a submersible motor that has ribs or vanes extending radially from its outer shell. In this embodiment the vanes or ribs extending radially from the outer shell of the submersible motor receive the fluid from the coolant distributor to provide cooling to the motor, taking advantage of the fact that some models of submersible motors have vanes or ribs, allowing a reduced cost of manufacture of the fluid distributor component of the cooling system.

Other objects and features of the invention will become apparent from consideration of the following description taken in connection with the accompanying drawings.

DESCRIPTION OF THE PREFERRED EMBODIMENT

Figure 3:
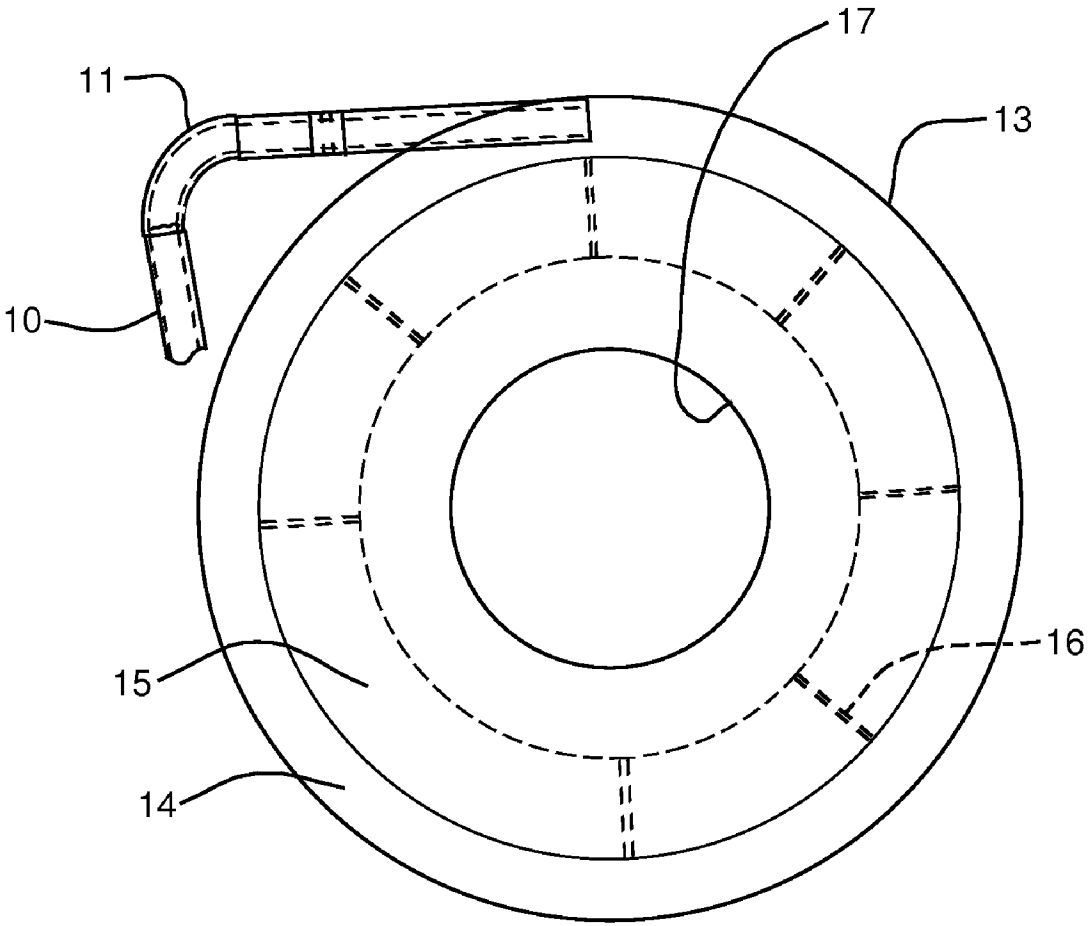
FIG. 3 is a cross section view through the toroidal component of FIG. 1, illustrating the tangential connection of the cooling conduit into the toroidal section.
Figure 4:
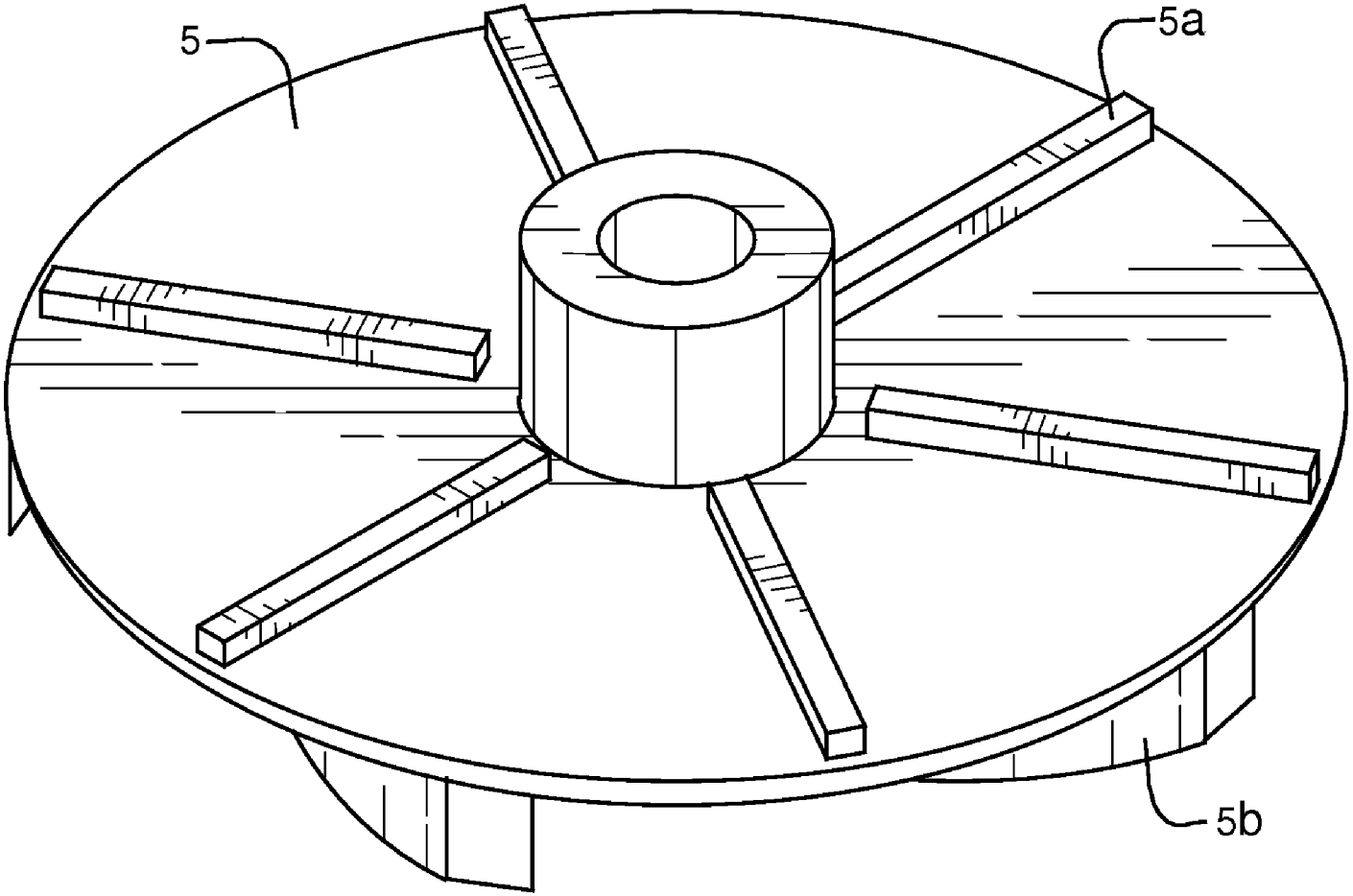
FIG. 4 is a perspective view of the impeller of FIG. 1, illustrating the primary vanes and back vanes.

The submersible centrifugal pump and variations of it shown in FIGS. 1-5 has a pump housing 1 made up of a casing 2 with an axial suction opening 3 and an opposite back cover 4. Within casing 2, impeller 5, configured with radial back vanes 5*a* and primary vanes 5*b*, is securely mounted on the shaft 6 that extends through the back cover 4 and bears the rotor of the electric driving motor 7. A section 8 of cooling system conduit 12 is located in the pump housing 1, and terminates at inlet 8A (FIG. 2) in close proximity to vanes 5*a* of rotating impeller 5, with its inlet axis intersecting the circumferential plane of impeller 5. Inlet 8*a* (FIG. 2) is located at a distance from the pump axis or shaft smaller than the outside radius of the impeller 5, but at a sufficiently large distance such that when the blades or vanes of the rotating impeller 5 sweep inlet 8*a* (FIG. 2) at normal pump speed, they create sufficient pressure to force solids ladened fluids into the inlet with enough velocity that the solids remain in suspension while the fluid is flowing through the full length of cooling system conduit 12. Conduit section 10 originates at conduit connection 9 to section 8 and terminates at the external end of tangential feed conduit 11 (FIG. 3). Inlet 8A (FIG. 2), section 8, connection 9, conduit section 10, and tangential feed conduit 11 make up the cooling system conduit 12.

Figure 1:
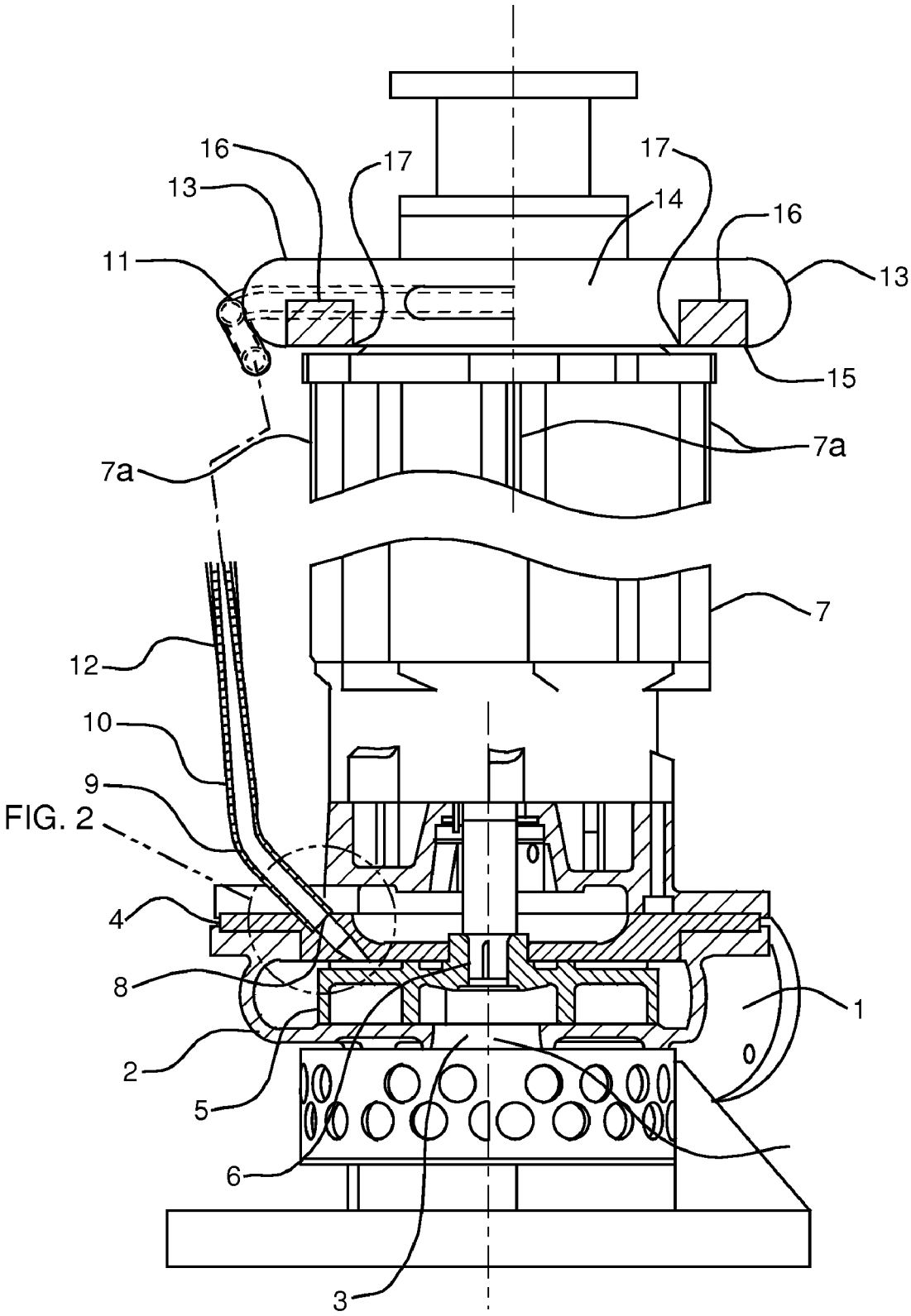
FIG. 1 is a diagrammatic and partial sectional view of a submersible pump and motor assembly with cooling conduit and open face coolant distributor according to the present invention.
Figure 2:
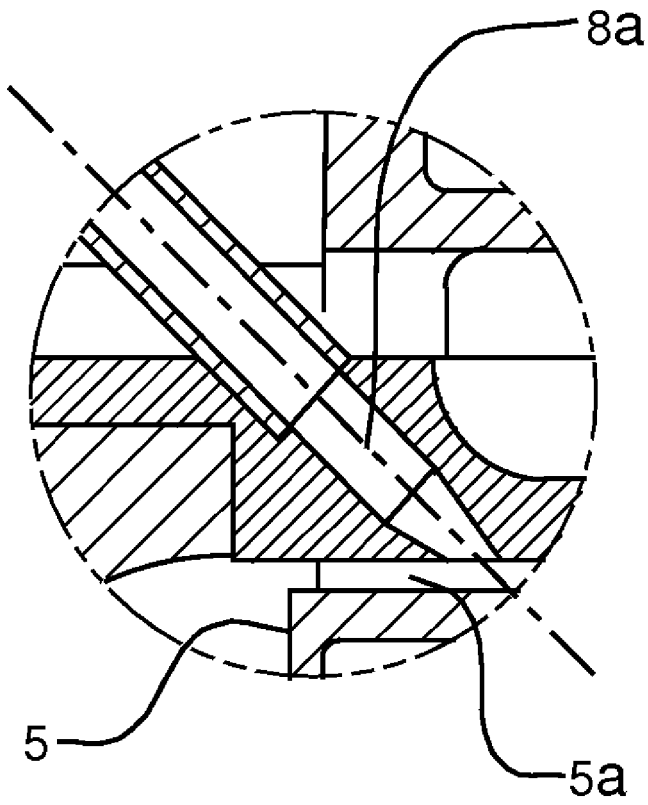
FIG. 2 is an enlarged view of a circular portion of FIG. 1, illustrating the cooling system inlet proximate the impeller.
Figure 5:
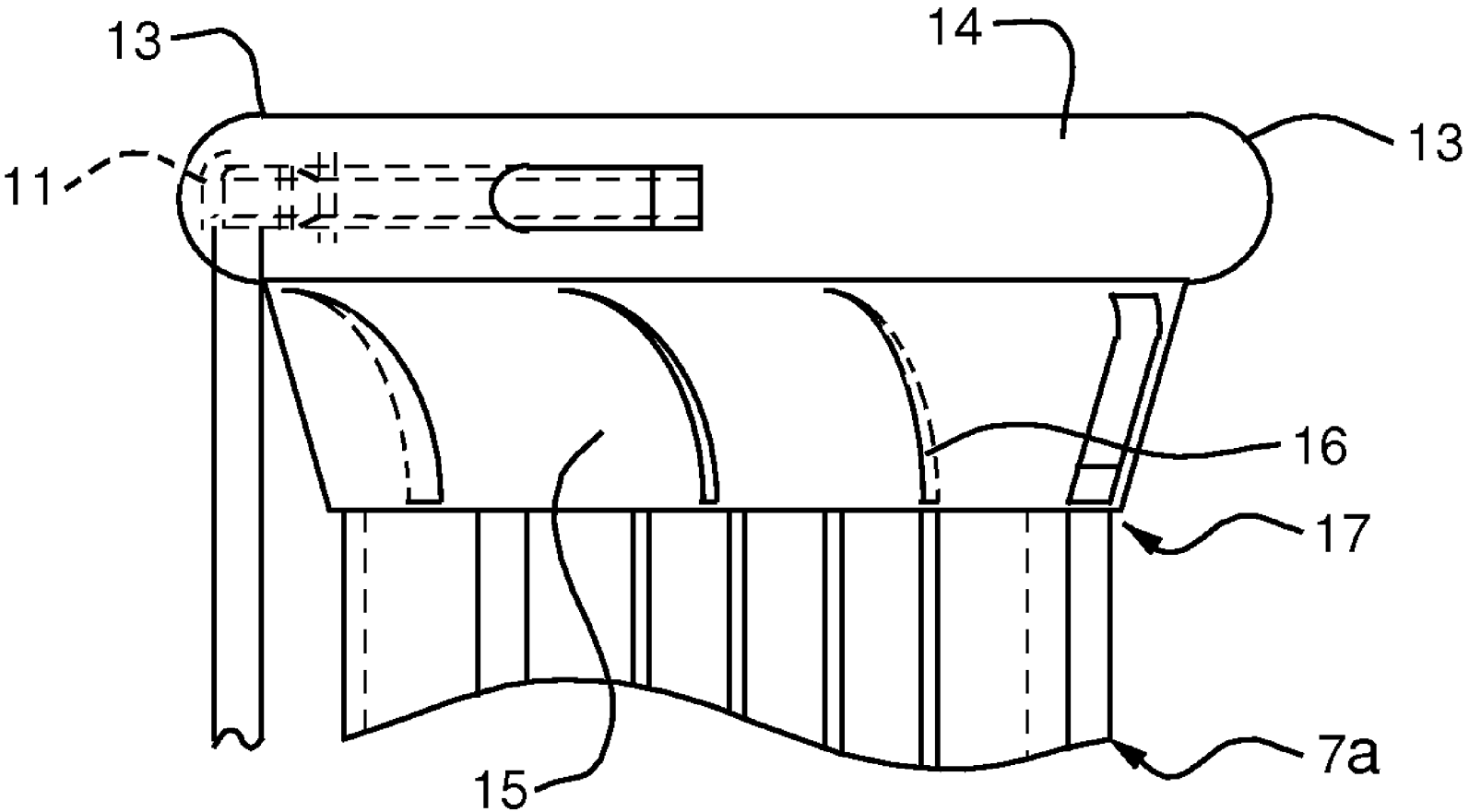
FIG. 5 is a partial side elevation of a toroidal component of the invention configured with a lower distributor section in the form of a conical, inward and downward directed skirt by which coolant is directed over the motor.

Coolant distributor 13 is mounted coaxially to, and in the general proximity of, the top of motor 7. The cooling system distributor has a toroidal section 14 that transits to a lower distributor section 15, which contains a plurality of vanes or ribs 16. Tangential feed conduit 11 pierces the outer wall of toroidal section 14 at such an angle that fluid discharge with any remarkable velocity from conduit 11 is immediately placed into circular flow around the circumference of distributor 13. Referring to FIG. 1, the lower distributor section 15 may be planar and circular, extending radially inward to a uniformly round discharge opening 17. Referring to FIG. 5, the lower distributor section 15 may be a conical skirt extending downward and inward from the toroidal section 14 terminating in a uniformly round discharge opening 17 around motor 7.

During operation of the described pump, solids-ladened fluid enters the pump housing 1 through axial suction opening 3 and is accelerated by centrifugal force radially outward gaining pressure as a result of the centrifugal action of the impeller 5. A portion of the solids ladened fluid enters inlet 8*a* and undergoes a shearing action as it enters from the passing vanes 5*a* of impeller 5. The diameter of inlet 8*a* being somewhat smaller than the minimum diameter anywhere else in cooling system conduit 12, combined with the shearing action of the impeller vanes 5*a* at close proximity, assures that any solids or particles of solid material admitted into inlet 8A will pass through cooling system conduit 12 and tangentially enter the toroidal section 14 of coolant distributor 13 suspended in the host fluid. In this embodiment, the fluid ladened with reduced sized solids travels through a minimum of 360 degrees of arc along the toroidal section 14 before gravity causes the flow to enter the lower distributor section 15 of the coolant distributor 13 whereupon the fluid ladened with reduced sized solids encounters a plurality of guide vanes or ribs 16 that direct the flow radially inward, redirecting the tangential velocity of the fluid, with reduced sized solids entering the lower distributor section 15, towards the motor 7. The fluid ladened with reduced sized solids discharged from coolant distributor 13 travels in a gravitationally induced downward and a lower distributor induced radially inward direction until exiting lower distributor section 15 at discharge opening 17 and impinging upon the sidewalls of the motor 7 , and on its external cooling vanes 7*a* if so configured, providing the necessary cooling to the motor 7 when it is running in an unsubmerged condition.

Other and various embodiments of the invention are within the scope of the claims that follow. For example, there is within the scope of the invention an open face cooling system for cooling the motor of a motorized, impeller-type, submersible pump operated in a host fluid ladened with solids, consisting of a cooling system inlet in the pump housing proximate the impeller and spaced apart from the axis of the pump such that the blades of the impeller sweep the face of the inlet with a shearing motion, thereby reducing the size of such solids as are present at the face of the inlet and forcing the fluid ladened with solids into the inlet.

There is a cooling system distributor with an open face toroidal section, which has an adjoined lower distribution section. The cooling system distributor is configured coaxially around and above the motor. There is a cooling system conduit connecting the inlet to a tangentially oriented nozzle incorporated in the open face toroidal section of the distributor, so that the solids ladened fluid forced by fluid pressure within the pump into the inlet, can flow through the cooling system conduit into said cooling system distributor with a circular flow, and discharge onto the motor.

As another example, there is a centrifugal pump consisting of a pump housing which is a casing with an axial suction opening and an outlet; an impeller within the pump housing; a shaft connecting the impeller to an electric driving motor; at least one cooling fluid inlet, although there may be two or more, located in the pump housing in close proximity to the rotating impeller at a distance away from the axis of the impeller not substantially larger than the full diameter of the impeller. There is a coolant distributor with at least one nozzle directed tangentially into a toroidal section that is connected to a lower distributor section configured with a coolant discharge end proximate the motor; and a coolant conduit connecting the cooling fluid inlet to the nozzle so that cooling fluid is directed into a circular flow within and around the toroidal section, then falling via the lower distributor section onto the motor.

The lower distributor section may be planar and circular, extending radially inward to a uniformly round discharge opening. It may be a skirt extending inward and downward from the toroidal section. It may have a rounded or conical shape or such other shape as will distribute fluid falling from the toroidal section onto the motor housing. It may extend around and downward at least partially the length of the motor so as to assure contact of the cooling fluid with the motor housing. The lower distributor may contain a plurality of guide vanes to help channel the fluid through its course. Alternatively or in combination, the motor may be configured with vertically oriented external cooling vanes extending radically from its outer shell, with the lower distributor structure extending downward over at least a portion of the motor's cooling vanes.

The toroidal section of the coolant distributor may have an open top, or a screened top, or be otherwise shielded to prevent foreign articles suspended or floating in the medium being pumped from descending into the toroidal section and flow path of the cooling fluid.

The discharge end of the lower distributor section may consist of the annulus formed between the motor and the lower or inner edge of the distributor section. The annulus may have a width greater than the diameter of the cooling fluid inlet to insure that materials in the cooling fluid that entered the cooling fluid inlet can pass out of the cooling system.

The cooling fluid inlet may be located outboard of and proximate to the impeller so that the ends of the blades of the impeller sweep the opening of the cooling fluid inlet during rotation. Alternatively or in combination, there may be a cooling fluid inlet configured above and proximate the impeller at a distance from the axis of the impeller of less than the full diameter of the impeller, where the upper edges of the impeller blades are sweeping the opening of the cooling fluid inlet during rotation.

The cooling fluid inlet may be of smaller diameter than the conduit and the nozzle. The cooling fluid inlet or inlets located in the pump housing in close proximity to the rotating impeller are preferable be at a distance from the axis of the shaft or impeller of not smaller than one half the full diameter of the impeller so as to generate sufficient pressure in the coolant conduit.

Various embodiments of the invention may include protective control systems such as a power shut off switch associated with one or more pressure sensors identified with either or both of: fluid pressure in the coolant conduit, which could indicate the presence of an adequate flow of coolant in the cooling system of the invention; and external fluid pressure, which could indicate whether the level in the fluid reservoir had fallen to below the level of the motor. Such control circuits and systems are well understood in the art, and are included here in combination with the invention to illustrate its ability to be adapted in such ways.

Other and various embodiments and equivalents within the scope of the appended claims will be readily apparent to those skilled in the art from the description and figures provided.

I claim:

1. An open face cooling system for cooling a motor of a motorized, impeller-type, submersible pump operated in a host fluid ladened with solids, comprising:

a cooling system inlet in a pump housing of said pump proximate an impeller and spaced apart from the axis of said pump such that vanes on said impeller sweep a face of said inlet with a shearing motion, thereby reducing the size of such solids as are present at said face of said inlet and forcing said fluid ladened with solids into said inlet, a cooling system distributor further comprising an open face toroidal section with an adjoined lower distribution section, said cooling system distributor being configured co-axially around and above said motor, and a cooling system conduit connecting said inlet to a tangentially oriented nozzle incorporated in said open face toroidal section of said distributor, whereby said solids ladened fluid forced by fluid pressure within said pump into said inlet, flow through said cooling system conduit into said cooling system distributor with a circular flow, and discharges therefrom onto said motor.

2. A centrifugal pump comprising a pump housing consisting of a casing with an axial suction opening and an outlet;

an impeller within said pump housing with vanes thereon;

a shaft connecting said impeller to;

an electric driving motor;

at least one cooling fluid inlet located in the pump housing in close proximity to the vanes of said impeller at a distance away from the axis of the impeller not substantially larger than the full diameter of the impeller;

a coolant distributor with at least one nozzle directed tangentially into a toroidal section that is connected to a lower distributor section configured with a coolant discharge end proximate said motor; and a coolant conduit connecting said cooling fluid inlet to said nozzle.

3. A centrifugal pump according to claim 2, said lower distributor section comprising a circular lower end extension of said toroidal section, extending radially inward towards a central circular said coolant discharge end proximate said motor.

4. A centrifugal pump according to claim 3, said lower distributor section comprising a conical section extending inward and downward from said toroidal section.

5. A centrifugal pump according to claim 3, said lower distributor section comprising a planar section extending radially inward from said toroidal section.

6. A centrifugal pump according to claim 3, said lower distributor containing a plurality of guide vanes.

7. A centrifugal pump according to claim 2 wherein said electric motor is configured with vertically oriented external cooling vanes extending radically from its outer shell, and said lower distributor extending downward over at least a portion of said cooling vanes.

8. A centrifugal pump according to claim 2, said coolant distributor having a screened top.

9. A centrifugal pump according to claim 2, said coolant distributor having an open top.

10. A centrifugal pump according to claim 5, said coolant discharge end and said motor comprising an annulus having a width greater than the diameter of said cooling fluid inlet.

11. A centrifugal pump according to claim 2, said cooling fluid inlet being located proximate to said impeller, the ends of the vanes of said impeller sweeping the opening of said cooling fluid inlet during rotation.

12. A centrifugal pump according to claim 2, said cooling fluid inlet being configured proximate said impeller at a distance from the axis of said impeller of less than the full diameter of said impeller, the edges of the vanes of said impeller sweeping the opening of said cooling fluid inlet during rotation.

13. A centrifugal pump according to claim 2, said inlet being of smaller diameter than said conduit and said nozzle.

14. A centrifugal pump according to claim 2, said at least one cooling fluid inlet located in the pump housing in close proximity to the impeller at a distance from the axis of said impeller not smaller than one half the full diameter of the impeller.

15. A centrifugal pump for conveying solids ladened fluids comprising a pump housing consisting of a casing with an underside axial suction opening and an outlet;

an impeller within said pump housing, said impeller configured with vanes;

a vertically oriented drive shaft;

an electric driving motor;

at least one cooling fluid inlet located in the pump housing in close proximity to the vanes of the impeller at a diameter not substantially larger than the full diameter of the impeller and not smaller than one half the diameter of the impeller;

a coolant distributor with a nozzle directed tangentially into a toroidal section that is connected to a lower distributor section configured with a coolant discharge end proximate said motor; and a coolant conduit connecting said cooling fluid inlet to said nozzle, said lower distributor section comprising a skirt extending from said toroidal section around and downward at least partially the length of said motor, said coolant distributor having an open top, said discharge end comprising the annulus formed between said motor and the lower edge of said skirt, said cooling fluid inlet being of smaller diameter than said coolant conduit and said nozzle, said annulus having a width greater than the diameter of said cooling fluid inlet.

16. A centrifugal pump according to claim 15, said lower distributor section containing a plurality of guide vanes.

17. A centrifugal pump according to claim 15, said electric motor being configured with external cooling vanes extending radically from an outer shell, said lower distributor section extending downward over at least a portion of said cooling vanes.

18. A centrifugal pump according to claim 15, said cooling fluid inlet being located proximate to said impeller, the ends of the vanes of said impeller sweeping the opening of said cooling fluid inlet during rotation.

19. A centrifugal pump according to claim 15, said cooling fluid inlet being configured above and proximate said impeller, the edges of the vanes of said impeller sweeping the opening of said cooling fluid inlet during rotation.

* * * * *

UNITED STATES PATENT AND TRADEMARK OFFICE

CERTIFICATE OF CORRECTION

PATENT NO. : 7,341,436 B2
APPLICATION NO. : 10/911194
DATED : March 11, 2008
INVENTOR(S) : Dale B. Andrews It is certified that error appears in the above-identified patent and that said Letters Patent is hereby corrected as shown below:

Title Page
Item [73], Assignee, delete "MN", insert -- MA --

Signed and Sealed this

Fourteenth Day of July, 2009

JOHN DOLL
*Acting Director of the United States Patent and Trademark Office*